United States Patent [19]

Halvorsen

[11] 4,256,336

[45] Mar. 17, 1981

[54] HOOK FOR LIFTING ROLLERS, IN PARTICULAR, A REELING DRUM HOOK

[76] Inventor: Kare E. Halvorsen, Prestegårdsjordet, 3070 Sande, Norway

[21] Appl. No.: 83,740

[22] Filed: Oct. 11, 1979

[30] Foreign Application Priority Data

Oct. 17, 1978 [NO] Norway ..... 783507

[51] Int. Cl.[3] ..... B66C 1/34

[52] U.S. Cl. ..... 294/82 R

[58] Field of Search ..... 294/78 R, 82 R, 83 R, 294/84; 24/230.5 R, 232 R, 232 G, 241 R, 241 P, 241 PP, 241 PS, 241 SB

[56] References Cited

U.S. PATENT DOCUMENTS

| | | | |
|---|---|---|---|
| 228,628 | 6/1880 | Grassick | 24/232 R |
| 459,431 | 9/1891 | Ziegler | 24/232 G |
| 815,723 | 3/1906 | Mahoney | 24/241 P |
| 894,345 | 7/1908 | Raymond | 294/84 |
| 1,520,576 | 12/1924 | Keaton | 24/241 PS |
| 1,736,707 | 11/1929 | Lake | 24/232 G X |
| 3,194,602 | 7/1965 | Gottwald | 24/241 P X |
| 3,620,563 | 11/1971 | Pierce | 294/82 R |

FOREIGN PATENT DOCUMENTS

| | | | |
|---|---|---|---|
| 956173 | 4/1964 | United Kingdom | 24/232 G |

*Primary Examiner*—Johnny D. Cherry
*Attorney, Agent, or Firm*—Ladas & Parry

[57] ABSTRACT

The invention relates to an improvement in a hook for lifting rollers, in particular a reeling drum hook. The object of the invention is to prevent the shaft of a roller from lodging on the tip of the hook. This is achieved by pivotally mounting a body on the tip of the hook, which body is formed as an extension of the tip and whereby a part of the body functions as a weight body.

4 Claims, 4 Drawing Figures

HOOK FOR LIFTING ROLLERS, IN PARTICULAR, A REELING DRUM HOOK

The invention relates to an improvement in a hook for lifting rollers, in particular, a reeling drum hook, which prevents the shaft of a reeling drum from lodging on the tip of the hook.

In paper manufacturing, the final step in the production process is usually the winding of the web of paper onto a roller core, which is constructed of a steel pipe secured to the drive shaft. Such a roller core is called a reeling drum. When a reeling drum is to be replaced, cranes with a hook on each side of the web of paper are used, the ends of the reeling drum being held in the hooks. The reeling drum is moved away from the winder while the papermaking machine continues to operate at full speed. The reeling drum with paper can weigh between 3 and 11 tons.

The operation of replacing a reeling drum involves great difficulties and is associated with elements of risk. Because the reeling drum hooks are located on either side of a broad web of paper, it is difficult to control that the hooks are holding the reeling drum correctly and securely on both sides of the roller, and this can cause difficulties. With the reeling drum hooks in use at present, the end section of the reeling drum may settle on the tip of the hook. If this happens, the reeling drum can fall off as it is being lifted, and it then constitutes a danger to life and limb.

The object of the present invention is to provide a modification of a reeling drum hook whereby the above drawbacks are avoided. It is thus a purpose of the invention to obtain a substantial increase in safety in the handling of reeling drums.

This object is achieved with an improvement whose characterizing features are disclosed in the appurtenant patent claims.

In principle, the improvement of the invention comprises the provision of an auxiliary tip on the tip of a conventional reeling drum hook, i.e., an extension of the tip, provided with a counterweight, and this device prevents the reeling drum from lodging on the tip of the hook per se. In addition, the configuration of the device ensures that the reeling drum will be retained more securely, such that it has less possibility of jumping out of the hook, something that can also occur with the hooks in use today.

Figure 1:
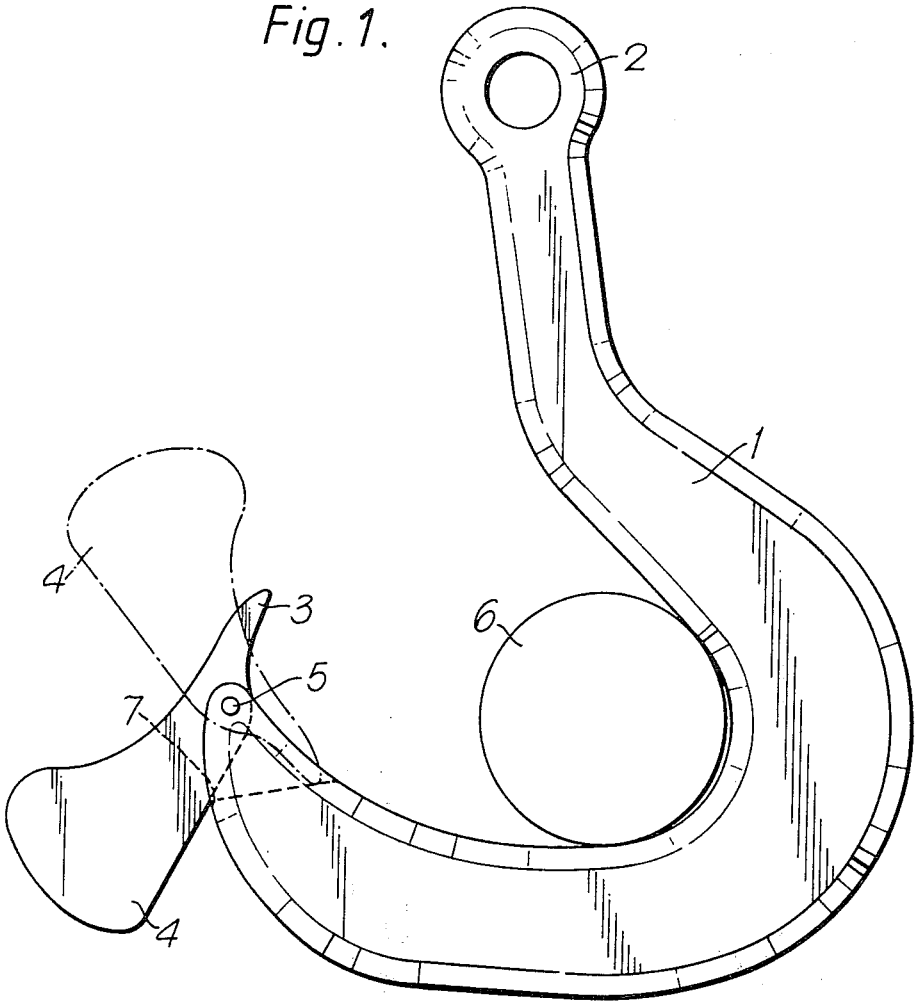
Figure 2:
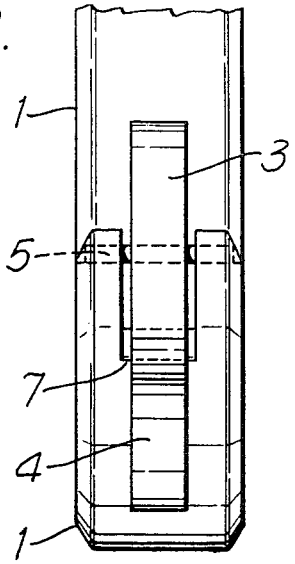
Figure 3:
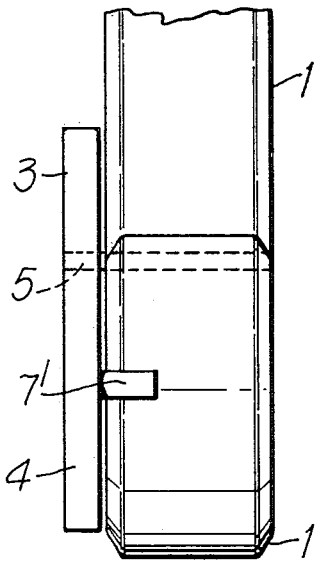
Figure 4:
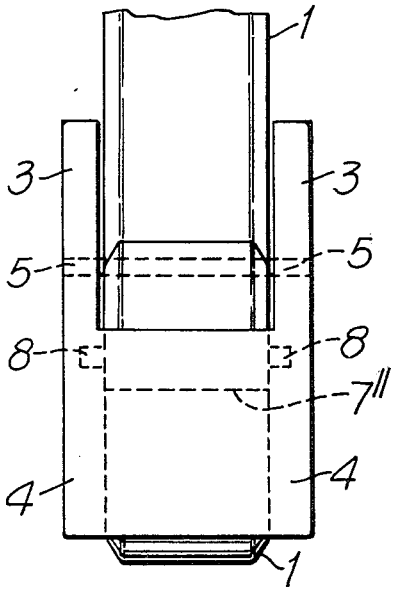

The invention will be discussed in greater detail in the following with reference to the embodiment examples shown in the accompanying drawings, where FIG. 1 is a side view of a reeling drum hook including the improvement of the invention, shown in two positions, FIG. 2 is a front view of the tip of the reeling drum hook with the improvement of the invention, and FIGS. 3 and 4 show two further embodiment examples of the invention.

The drawings show a reeling drum hook 1 with a lug 2 by which the hook is suspended from a crane. An auxiliary body is mounted at the tip of the hook, one end 3 of the body being formed as an extension of the tip and the other end 4 being formed as a weighting body. In the area between the two end parts 3 and 4, a pivot bolt 5 passes through the body and through the tip of the hook 1, such that the body 3, 4 can pivot about the bolt 5 relative to the tip of the hook. The body is thus able to move between the two positions shown in FIG. 1. In this embodiment, the body 3, 4 is disposed in a groove in the tip of the hook, such that the weight 4 will come to rest against the bottom of the groove at the point marked 7 and will thus be stopped in this position. The reeling drum is designated by reference numeral 6.

Owing to the weight 4, the body 3, 4 will assume the position shown with the solid lines on FIG. 1. When the reeling drum is being inserted into the hook, it will come into contact with or strike against the part 3, causing the body 3, 4 to pivot up into the position shown with the dashed lines in FIG. 1. This will cause the reeling drum to be guided into the bowl of the hook, whereupon the body 3, 4, owing to the weight 4, will fall back into its starting position, indicated by the solid lines. In this position, the tip extension 3 now forms a safety barrier to prevent the reeling drum from falling out of the hook, while at the same time one has ensured that the drum has been securely inserted into the hook. To increase the safety still further and to make certain that the reeling drum cannot settle on the tip of the hook, the outermost point on the end of the tip extension is preferably arranged such that it lies on the hook side of a vertical line through the axis of the pivot connection 5. In this way, even if the hook is guided vertically upwards in a direction toward the tip, the tip extension will flip around and guide the reeling drum into the bowl of the hook.

In the embodiment shown in FIG. 3, the body is disposed on one side of the hook 1. The body can have a configuration similar to that shown in FIG. 1, and pivots about a bolt 5. As the body does not have contact with the hook at the location designated by numeral 7, as was the case in the preceding example, a projection 7' must therefore be provided to stop the body in the correct position. This projection 7' is shown on the drawing as being arranged on the weight 4, but it could of course also be provided on the hook itself, for example, being permanently welded to the hook.

FIG. 4 shows an embodiment in which the body 3, 4 is formed with two arms 3 lying on either side of the hook 1, the weight 4 also extending outside the hook and constituting a connection between the two arms on either side of the hook. In this example, one again obtains a direct stopping abutment of the weight 4 against the hook 1 along a line designated 7''. Another possibility is to make the body of two parts connected by an intermediate connecting rod, the rod then being arranged so as to coincide with the line 7''. To prevent the body from pivoting in the opposite direction, stops 8 are pivoted.

It is thus apparent that many different embodiments of the invention are possible within the scope of the invention.

Having described my invention, I claim:

1. A hook for lifting rollers comprising: a main hooked body having a tip; and an auxiliary body which is pivotally mounted on the tip of said main body, one end of said auxiliary body being formed as an extension of the tip and the other end thereof as a weight, the pivot connection between the main body and the auxiliary body being arranged at the tip of the main body and between the two ends of the auxiliary body, and the outward movement of said one end of said auxiliary body being restricted by abutment of said other end thereof against the main body, and wherein said one end of said auxiliary body is located on the inward side of a vertical line through said pivot connection; and said other end is on the outward side of said line, and said auxiliary body has an uppermost side which extends from said one end to said other end and generally slants downward and outward with respect to said tip when said auxiliary body is at rest.

2. A hook according to claim 1, wherein said tip has a groove in its middle region for receiving said auxiliary body, the lower edge of said groove forming a stop surface to prevent further rotation of said auxiliary body.

3. A hook according to claim 1, wherein said auxiliary body is disposed on the side of the hook and has a projection extending toward the side of the hook for restricting the rotation of said auxiliary body upon contact of the projection against the hook.

4. A hook according to claim 1, wherein said auxiliary body has a central groove in said one end to permit it to be placed around said tip.

* * * * *